United States Patent [19]

Kawakami et al.

[11] 4,049,155

[45] Sept. 20, 1977

[54] APPARATUS FOR ASSEMBLING SLIDERS TO SLIDE FASTENER CHAIN

[75] Inventors: Koichi Kawakami, Kurobe; Tatsuo Osaki, Uozu, both of Japan

[73] Assignee: Yoshida Kogyo Kabushiki Kaisha, Japan

[21] Appl. No.: 457,785

[22] Filed: Apr. 4, 1974

[30] Foreign Application Priority Data

Apr. 18, 1973 Japan ..... 48-46258[U]

[51] Int. Cl.[2] ..... B21D 53/52

[52] U.S. Cl. ..... 221/192; 29/768; 221/270

[58] Field of Search ..... 221/192, 251, 298, 270; 29/207.5 SL, 408, 409, 768, 809

[56] References Cited

U.S. PATENT DOCUMENTS

| | | | |
|---|---|---|---|
| 3,112,932 | 12/1963 | Marsh | 221/192 X |
| 3,600,786 | 8/1971 | Hansen | 29/207.5 SL |
| 3,663,000 | 5/1972 | Periman | 29/408 X |

FOREIGN PATENT DOCUMENTS

| | | | |
|---|---|---|---|
| 446,076 | 3/1949 | Italy | 221/298 |

*Primary Examiner*—Robert B. Reeves
*Assistant Examiner*—Francis J. Bartuska
*Attorney, Agent, or Firm*—Bucknam and Archer

[57] ABSTRACT

A slider-applying apparatus is disclosed for assembling sliders to a slide fastener chain, particularly to such fastener chain which has previously been attached to a garment or the like. A working table provided in the apparatus has a cut-away, "bay"-like recess at its front end adjacent a slider holding means, which recess serves to provide free space for the fastener chain and attached garment to move forward therethrough past the slider holder.

4 Claims, 2 Drawing Figures

APPARATUS FOR ASSEMBLING SLIDERS TO SLIDE FASTENER CHAIN

BACKGROUND OF THE INVENTION

This invention relates to improvements in and relating to apparatus for assembling sliders to slide fasteners, more particularly to such apparatus which are designed to apply sliders to a slide fastener chain already attached to a garment or the like.

A number of slider assembling apparatus are known for the function described, and some advanced apparatus include a working table, a hollow guide structure projecting upwardly therefrom and a slider holding means vertically movable within the guide structure and adapted to receive and releasably retain sliders for assemblage upon the fastener chain. While such prior art devices have many advantages per se, they have suffered from equipment failures and consequent maintenance inconveniences, hence retarded rate of assembly due principally to the arrangement of the working table wherein the table front end at which an operator performs has a substantially straight marginal line and further in some instances is crowded with associated mechanical parts for changing the direction of passage of sliders and other fastener components. This has greatly interferred with the operation of threading sliders through a slide fastener chain, such trouble being greater when assembling sliders to a fastener chain previously attached to trousers or other bulky garments.

SUMMARY OF THE INVENTION

It is therefore an object of the present invention to provide an improved slider-applying apparatus which will eliminate the above-noted difficulties of the prior art and which will contribute to increased rate of assembly with a minimum of fatigue imposed upon the operator.

This object and other features of the invention will be apparent from the following description taken in conjunction with the accompanying drawings which illustrate by way of example a preferred form of the invention.

DESCRIPTION OF THE PREFERRED EMBODIMENTS

Figure 1:
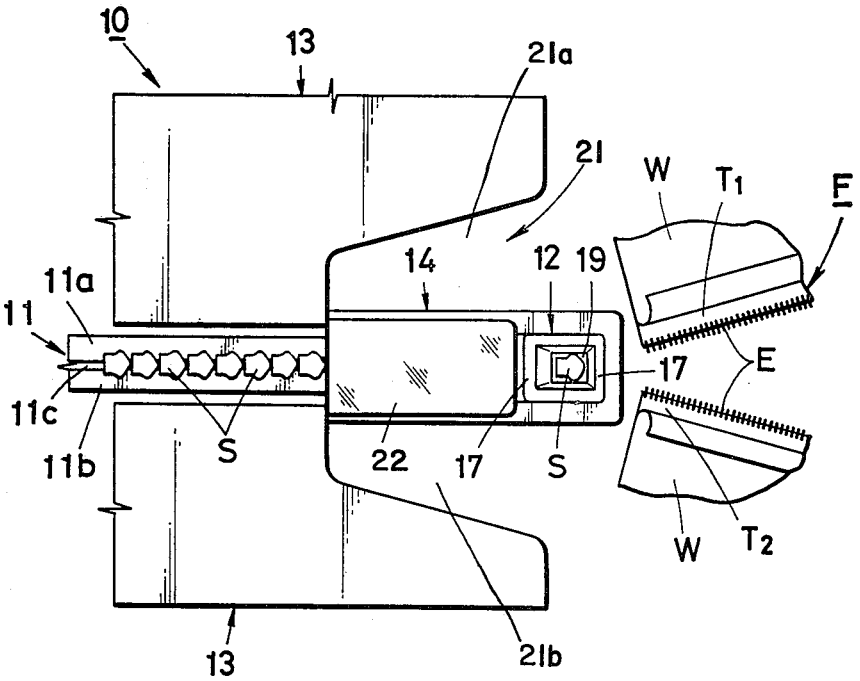
FIG. 1 is a top plan view of a slider-applying apparatus embodying the invention.

Referring now to the drawings and FIG. 1 in particular, there is schematically shown a slide fastener chain F which comprises, as in the usual construction, a pair of opposed stringer tapes $T_1$, $T_2$ each having secured to a longitudinal edge a series of continuous or discrete fastener elements E upon which a slider S is to be mounted, the two stringers being spread apart to facilitate the assembly of sliders in a well known manner. As shown, the stringer tapes $T_1$, $T_2$ have previously been attached to a garment W,W. The slider S may be of any known construction wherein it has a pair of substantially parallel wings interconnected at one end by a yoke which, with the wings, define a Y-shaped channel for guiding the fastener elements into and out of interlocked relation, and a pull tab pivotally connected to one of the wings for operating the slider.

Designated generally at 10 is a slide-applying apparatus provided in accordance with the invention, which apparatus essentially comprises a parts supply chute 11, a parts holder 12 and a working table 13. The supply chute 11 in the illustrated embodiment is adapted to deliver sliders S by gravity from a parts feeder (not shown) to the parts or slider holder 12, for which purpose the chute 11 is constructed with parallel rails **11*a*, 11*b* spaced apart by an elongate slots 11*c* through which the pull tabs of the sliders S depend during gravity delivery down a sloping section 11*d*. The slider supply chute 11, when viewed in projection to the plane of the table 13, extends preferably along a straight line of path connecting between the parts feeder and the slider holder 12** so as to obviate the necessity of adding extra devices for changing the direction of parts fed relative to the position of the parts holder.

Figure 2:
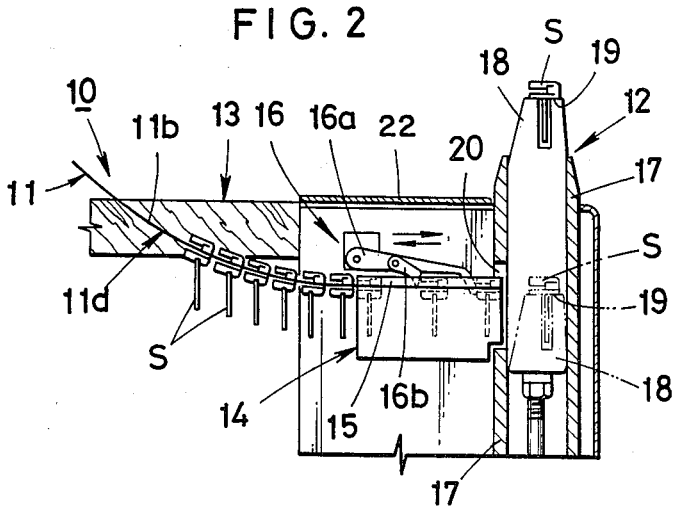
FIG. 2 is a cross-sectional view of the same.

The end of the sloping section **11*d* of the chute 11 is connected with a chute support 14, more specifically with a horizontal rail track 15 provided therein. The chute support 14 further includes movable means 16 for accurately feeding one slider at a time to the slider holder 12, which movable means 16 comprises a large finger 16*a* and a small finger 16*b* pivotally connected thereto at a position such that one slider has a loose fit in the space between the two fingers. The large finger 16*a* as better shown in FIG. 2**, is vertically movable and at the same time horizontally reciprocable as shown by the arrows, the mechanical details for such movements being omitted for the purposes of brevity since they may readily occur to the minds of those skilled in the art.

The slider holder 12 comprises a vertically disposed hollow guide block 17 partly protruding above the surface of the working table 13 and a slider retainer 18 vertically movable through the block 17. The slider retainer 18 has a slider rest 19 upon which the slider S is releasably retained. The slider retainer 18 moves vertically between a first position in which the slider rest 19 lies substantially flush with the horizontal rail track 15 so as to receive sliders S one at a time as this slider is fed by the movable means 16 through an opening 20 in the guide block 17, and a second position in which the slider rest 19 carrying the slider S thereon is exposed to view above the upper end of the guide block 17 so as to allow the slider to be assembled on the fastener chain F. The precise details of the form and construction of the slider holder 12 are disclosed in and form the subject matter of a copending application filed by the present applicants, and hence will require no further description here as they do not constitute any positive part of the invention.

In accordance with the invention, the working table 13 is provided with a cutaway recess or bay 21 at the front end behind the slider holder 12. The cutaway recess 21 in the table 13 diverges toward the slider holder 12 and is subdivided by the chute support 14 into symmetrical halves **21*a*, 21*b* extending on opposite sides of the support 14. The width and depth of the recess 21 may be such that when threading the fastener chain F through the slider S clamped on the retainer 18, the operator can freely move the fastener chan F together with its garment W past the slider holder 12 for a desired length towards the opposite end of the table 13. More specifically, this arrangement will permit the operator to advance the fastener chain F and its attached garment W uninterruptedly through cutaway recess 21, simply letting the garment, which is relatively heavy and bulky, depend through bifurcated recesses 21***a*, 21*b* on opposite sides of the chute support 14.

Designated at 22 is a transparent cover plate on window provided above the chute support 14 for inspecting the condition of sliders S sequentially delivered thereto.

What is claimed is:

1. A slider-applying apparatus for manually applying a slider to a fastener chain previously attached to a garment or the like, which comprises a supply chute having spaced parallel rails for delivery of sliders therebetween, a chute support having a horizontal track connected to one end of said chute, a vertically movable slider holder located adjacent said chute support and adapted to receive one slider from said chute and releasably retain said slider at a time for assembling said slider on a fastener chain previously attached to a garment or the like, and a working table having a cutaway recess at its front end behind said slider holder directly over said chute support, said recess being open to said front end and subdivided by said chute support into symmetrical halves positioned to allow a portion of the garment to depend on each side of each slider holder.

2. A slider-applying apparatus as defined in claim 1 wherein said cutaway recess diverges towards said slider holder in a symmetrical manner.

3. A slider-applying apparatus as defined in claim 1 wherein said chute support includes movable means for feeding one slider at a time to said slider holder, said means comprising a first finger and a second finger pivotally connected to said first finger.

4. A slider-applying apparatus as defined in claim 1 wherein there is provided a transparent window above said chute support for inspecting the condition of sequentially delivered sliders.

* * * * *